United States Patent [19]

MacLaine et al.

[11] Patent Number: 4,561,037

[45] Date of Patent: Dec. 24, 1985

[54] ELECTROSTATIC SPRAYING

[75] Inventors: Colin G. MacLaine; David J. Owen, both of Yarm, United Kingdom

[73] Assignee: Imperial Chemical Industries PLC, Hertfordshire, England

[21] Appl. No.: 626,119

[22] Filed: Jun. 29, 1984

Related U.S. Application Data

[63] Continuation-in-part of Ser. No. 589,221, Mar. 13, 1984.

[30] Foreign Application Priority Data

| | | |
|---|---|---|
| Mar. 25, 1983 | [GB] United Kingdom | 8308345 |
| May 20, 1983 | [GB] United Kingdom | 8313959 |
| Aug. 18, 1983 | [GB] United Kingdom | 8322308 |
| Oct. 5, 1983 | [GB] United Kingdom | 8326666 |

[51] Int. Cl.[4] ..... B05B 5/02

[52] U.S. Cl. ..... 361/228; 239/706; 361/235

[58] Field of Search ..... 361/227, 228, 235; 239/690, 706

[56] References Cited

U.S. PATENT DOCUMENTS

| | | | |
|---|---|---|---|
| 3,273,015 | 9/1966 | Fischer | 361/227 |
| 3,731,145 | 5/1973 | Senay | 361/227 |
| 4,186,421 | 1/1980 | Twitchett | 361/235 X |
| 4,356,528 | 10/1982 | Coffee | 361/228 X |

*Primary Examiner*—Harry E. Moose, Jr.

*Attorney, Agent, or Firm*—Cushman, Darby & Cushman

[57] ABSTRACT

Portable electrostatic spraying apparatus having a low stored energy wherein the capacitor of the high voltage circuit is formed by the capacitance between a lead connecting the high voltage generator output to the spray nozzle and a lead connected to the other side of the generator output.

10 Claims, 5 Drawing Figures

ELECTROSTATIC SPRAYING

This application is a continuation-in-part of our Application Ser. No. 589,221 filed Mar. 13, 1984.

This invention relates to electrostatic spraying. One form of electrostatic spraying apparatus, for example for agricultural or horticultural use, comprises a portable spray gun including a spray nozzle, means for applying a high potential to said nozzle, and means for supplying to said nozzle the liquid to be sprayed from a container of the liquid mounted on the spray gun. Examples of such electrostatic spraying apparatus are described in, inter alia, U.S. Pat. No. 4,356,528.

It has been proposed in U.S. Pat. No. 3,212,211 to produce the necessary high voltage for a portable electrostatic spraying device from a low voltage power supply, e.g. batteries, by means of a high voltage generator producing rectified high voltage pulses which charge a capacitor connected across the generator output. The charge on the capacitor is used to maintain the requisite potential at the spraying nozzle.

Clearly, to obtain electrostatic atomisation, the potential at the nozzle has to be maintained at above a certain minimum voltage, but should not be so high that corona discharge takes place. Generally, to effect electrostatic atomisation, the potential at the nozzle will need to be in an excess of 5 kV, and often above 10 kV, although the precise minimum value required will depend, inter alia, on the nozzle design. The maximum voltage required is generally not more than 25 kV.

In low cost generators it is generally necessary to employ a switching system in the generator which produces rapid changes of current in the primary of a step-up transformer. The magnitude and rapidity of the current changes in the primary determine the magnitude and shape of the high voltage pulses: the magnitude is restricted by the need to avoid excessive voltages at the nozzle which would give rise to corona discharge. The rapid change of current in the transformer primary is conveniently achieved by periodically effecting the rapid discharge of a capacitor in the primary circuit through the transformer primary. Such rapid discharge may be effected by means of a triggering unit connected, in series with the transformer primary, across the primary circuit capacitor. The triggering unit is arranged to discharge the primary circuit capacitor, via the transformer primary, typically through a thyristor or a gas gap discharge tube, when the voltage across the primary circuit capacitor, and hence across the triggering unit, reaches a predetermined value.

The frequency of operation of the triggering unit, and hence the frequency with which the high voltage pulses are generated, thus depends on the rate of charging of the primary circuit capacitor.

This rate of charging will of course depend on the capacitance of the primary circuit capacitor and the current supplied thereto. In order to obtain high voltage pulses of adequate magnitude to achieve the desired nozzle potential under load, the primary circuit capacitor will generally need to have a fairly large capacitance. Consequently to keep the current drain on the low voltage power source small, the charging rate of the primary circuit capacitor and hence the rate of actuation of the triggering device, and thus the frequency of the high voltage pulses must be relatively low.

As mentioned hereinbefore, the high voltage pulses are rectified and used to charge a capacitor in the high voltage circuit to maintain the required potential at the spray nozzle. If the capacitance of this capacitor in the high voltage circuit is sufficient, there will be little variation of the potential at the nozzle between pulses since the load represented by the transfer of charge at the nozzle to the liquid to effect electrostatic atomisation, together with leakage currents, will represent dissipation of only a small proportion of the charge on the capacitor.

However, if the capacitor has a high capacitance, the high voltage circuit will have a high stored energy. A high stored energy is undesirable as it may present safety hazards, for example electric shocks to the operator from accidental contact with the nozzle. Desirably the stored energy is below 10 mJ. The stored energy is given by ($CV^2/2$) where V is the voltage and C is the capacitance. Hence to achieve a stored energy below 10 mJ the capacitance must be below $$\frac{2 \times 10^4}{V^2} \text{ pF}$$

where V is the voltage expressed in kilovolts, i.e. below 50 pF when the voltage is 20 kV.

The load current, represented by the transfer of charge to the liquid at the nozzle, required to effect atomisation is relatively small and, provided that the leakage currents are small, it would be possible to use a high voltage circuit having a stored energy below 10 mJ.

However, not only are capacitors capable of operation at high voltages expensive, but, even those capacitors of the relatively low capacitance required, exhibit considerable leakage currents at such high voltages.

At these relatively low values of capacitance the charge dissipated as a result of the leakage currents represents a significant proportion of the charge on the capacitor with the result that, between the pulses applied to the capacitor, the voltage at the nozzle is liable to drop to below that required for spraying.

While this could be counteracted by increasing the frequency of the high voltage pulses applied to the capacitor in the high voltage circuit, as explained hereinbefore, increasing the frequency results in an increase in the current drain on the power supply. Consequently to maintain the current drain at an acceptable level, e.g. to give an adequate life where dry batteries are employed as the low voltage power source, the frequency with which the pulses can be applied to the high voltage capacitor is limited, generally to below about 50 Hz.

We have now devised an arrangement, having a low stored energy high voltage circuit, that can be operated at a frequency that gives an acceptable current drain on the power source.

According to the present invention we provide a portable electrostatic spraying apparatus including (a) a spray nozzle, (b) means to supply liquid to be sprayed to said spray nozzle, (c) a low voltage power source, (d) a high voltage generator powered by said low voltage power source, whereby rectified high voltage pulses may be produced across its output, (e) a capacitor connected to said nozzle and to one side of said generator output, whereby said capacitor may be charged by said rectified high voltage pulses so that said nozzle may be maintained at a sufficiently high potential, with respect to the other side of said generator output, to cause electrostatic atomisation of said liquid at said nozzle, characterised in that capacitor has a value below $$\frac{2 \times 10^4}{V^2} \text{ pF},$$

where V is the average voltage, expressed in kilovolts, that said generator is capable of maintaining at said nozzle, and in that said capacitor is formed by the capacitance between a lead connecting said one side of the generator output to said nozzle and a lead connected to said other side of the generator output, said generator being capable of producing said high voltage pulses of such magnitude and frequency that the potential at said nozzle may be maintained at a sufficient value to cause electrostatic atomisation of the liquid but without corona discharge.

By the use of the lead from one side of the generator output to the nozzle, in conjunction with a second lead connected to the other side of the generator output as the capacitor, sufficient capacitance can be obtained with negligible leakage current. The two leads should be in sufficiently close proximity to give the requisite capacitance which is generally within the range $$\frac{2 \times 10^3}{V^2} \text{ to } \frac{2 \times 10^4}{V^2} \text{ pF (where } V \text{ is in kV).}$$

The capacitance is preferably within the range 10 to 50 pF.

For example two separate insulated wires each having a length of about 0.5 m may be twisted together as necessary to give the requisite capacitance. The leads may of course be longer but spaced sufficiently far apart over some or all of their length that the capacitance is at the requisite level. Alternatively a suitable length of a twin core or coaxial cable may be employed.

Since a capacitor formed by two such leads will give negligible leakage current, the leakage current between pulses will be markedly reduced, enabling sufficient potential to be maintained at the nozzle.

As mentioned hereinbefore the average potential at the nozzle will depend on the frequency and magnitude of the high voltage pulses applied to the capacitor: the magnitude is restricted by the need to avoid voltages that would give rise to corona discharge. The frequency of the pulses is typically in the range 10–40 Hz, and preferably is in the range 15–30 Hz. The requisite frequency will depend on the load applied by the liquid being sprayed which in turn will depend on the properties, e.g. resistivity, of the liquid and on the volumetric flow rate. The latter is preferably below 0.25, particularly below 0.1 ml/s. A rate of 0.05 ml/s typically represents a load of less than 100 nA.

If desired the generator may be provided with means for varying the frequency and/or magnitude, i.e. peak voltage, of the high voltage pulses as the volumetric flow rate is varied.

Although, as a result of using the leads from the high voltage generator to form the capacitor, the leakage current through the capacitor is virtually eliminated, leakage of charge from the capacitor will occur between pulses, inter alia, as a result of the reverse leakage current of the rectifier. The rectifier reverse current may be significant in relation to the load presented by transfer of charge to the liquid being sprayed and will affect the minimum frequency required of the generator. We prefer to employ as the rectifier a high voltage diode rated at a leakage current of less than 1 $\mu$A at 37 kV at 20° C. Such a diode will have a reverse leakage current of less than about 100 nA at 20 kV at 20° C.

The spraying apparatus preferably comprises an elongated member intended to be held in the hand with the low voltage power supply, e.g. batteries, and high voltage generator in one end thereof with the spray nozzle at the other end. The leads forming the high voltage circuit capacitor thus can extend along the elongated member to connect the nozzle to the generator.

In a preferred arrangement one lead is connected to the nozzle while the other is connected to, or provides, an electrically conductive member adjacent to but spaced from the nozzle. In assessing the lead capacitance, the capacitance between the nozzle and such an electrically conductive member should be taken into account. The electrically conductive member is preferably maintained substantially at earth potential, for example by providing a connection to earth from that lead via the operator. Such an earthed electrically conductive member can then act as a field adjusting electrode as described in aforementioned U.S. Pat. No. 4,356,528.

In one form of the apparatus an elongated holder having the high voltage generator and a receptacle for receipt of the low voltage power source, e.g. batteries, at one end is provided, at the other end, with a receptacle for receipt of a canister of the liquid to be sprayed. The nozzle may form part of the holder or may be attached to the canister. In the latter case means are provided in the holder for making electrical connection between the lead from the one side of the high voltage generator and the nozzle.

The apparatus is of particular utility for the spraying of liquids, such as pesticides, polishes, and the like at low volumetric flow rates. The liquid preferably has a resistivity of $10^7$ to $10^{11}$ ohm. cm.

The liquid may be supplied to the spray nozzle by simple gravity feed. However this is disadvantageous in many cases since it restricts the spatial orientations of the nozzle that can be used. This problem can be overcome by supplying the liquid to the nozzle from a pressurised container; in particular the liquid can be supplied from a container containing the liquid and a compressed pressurising agent.

It is preferred that the container is arranged so that the pressurising agent is not dispensed through the nozzle with the liquid to be sprayed. In this way the atomisation of the liquid by the electrostatic forces is not affected by the emergence of the pressurising agent. In one preferred arrangement the container comprises a barrier pack with the liquid to be sprayed contained within a collapsible inner container located within the outer container with the pressurising agent fluid in the space between the inner and outer containers.

The rate of delivery of the liquid to the spray nozzle will depend on the pressure exerted by the pressurising agent (which is often a gas at ambient temperatures and atmospheric pressure, but is liquid at the pressure prevailing within the container). We have found that the pressure exerted by the pressurising agent is liable to considerable fluctuation as the ambient temperature varies, with the result that the liquid supply rate to the nozzle is also liable to considerable fluctuation: indeed over the range of ambient temperatures liable to be encountered in use of the spray gun, particularly where such use is outdoor, the pressure exerted by the pressurising agent, and consequently the flow rate, may vary, in some cases, by a factor of four or more.

Variations in flow rate will affect the size, and size distribution, of the liquid droplets formed by electostatic atomisation. Such variation in droplet size is undesirable since for any given liquid there is an optimum droplet size, or size range, for the intended use of the liquid.

For example, when spraying plants with a pesticide formulation, if the droplets are too large, the amount of "wrap-around", giving coating on the underside of plant leaves, is reduced; whereas if the droplets are too small, they are liable to be unduly affected by factors such as wind strength and so may drift onto plants other than those intended and/or on to the operator.

As a further feature of the invention we have devised a way of overcoming these difficulties by varying the nozzle potential to control the droplet size.

Accordingly the present invention further provides, in electrostatic spraying apparatus of the type hereinbefore described for spraying a liquid as droplets from a nozzle supplied with said liquid from a pressurised container by applying a high voltage to said nozzle, the improvement comprising means to monitor the ambient temperature and to vary the average voltage applied to said nozzle in response to said monitored temperature to maintain the average droplet size within a predetermined range.

The average voltage at the spraying nozzle can be varied by variation of the amplitude, frequency and/or shape of the high voltage pulses. Such variations can be brought about by appropriate variation in the low voltage circuit, e.g. of the magnitude and/or frequency of the current changes in the transformer primary winding and/or the rate of change thereof.

By incorporating a temperature sensitive electrical component, e.g. a thermistor, into the spray apparatus and using the variation in the electrical properties of this component with temperature to modify the transformer primary current changes, the average high voltage applied to the nozzle can be varied.

The average nozzle voltages required to give a specified droplet size or size distribution at various flow rates of a given liquid can readily be determined by experiment. Typically for a given liquid at a given flow rate, an average voltage of 15 kV may be required at the nozzle. If the flow rate is increased by a factor of two, the average voltage required to obtain the same, or a similar, droplet size is typically increased to 20 kV.

Likewise variation in pressurising agent pressure, and hence liquid flow rate, with temperature can also be readily determined.

From this data, and from the temperature characteristics of the temperature sensitive component, the appropriate circuitry can be devised to provide the necessary variation in nozzle voltage to maintain the droplet size within the desired range.

The invention is illustrated by reference to the accompanying drawings wherein.

Figure 1:
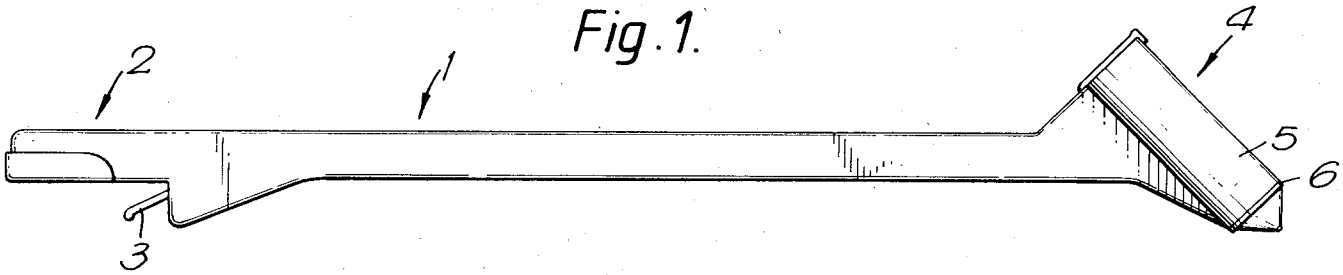
FIG. 1 is an elevation of one form of the apparatus.

Referring first to FIG. 1, the apparatus comprises an elongated member 1 having a handle portion 2 incorporating a trigger 3 and a sprayhead assembly 4 comprising a sleeve 5 in which a cartridge containing the liquid to be sprayed is inserted. The cartridge has a mechanically actuated valve and a nozzle to which a high voltage can be applied. When the cartridge valve is open and a high voltage is applied to the nozzle, the liquid is electrostatically atomised as a spray through an orifice at the lever end of the sprayhead assembly 4. To enhance the spray there is disposed around the sleeve 5, but insulated from the nozzle, an annular conductor 6 constituting a field intensifying electrode e.g. as described in aforementioned U.S. Pat. No. 4,356,528.

The shaft of the elongated member 1 comprises a casing formed by two shell mouldings of an electrically insulating material.

Figure 2:
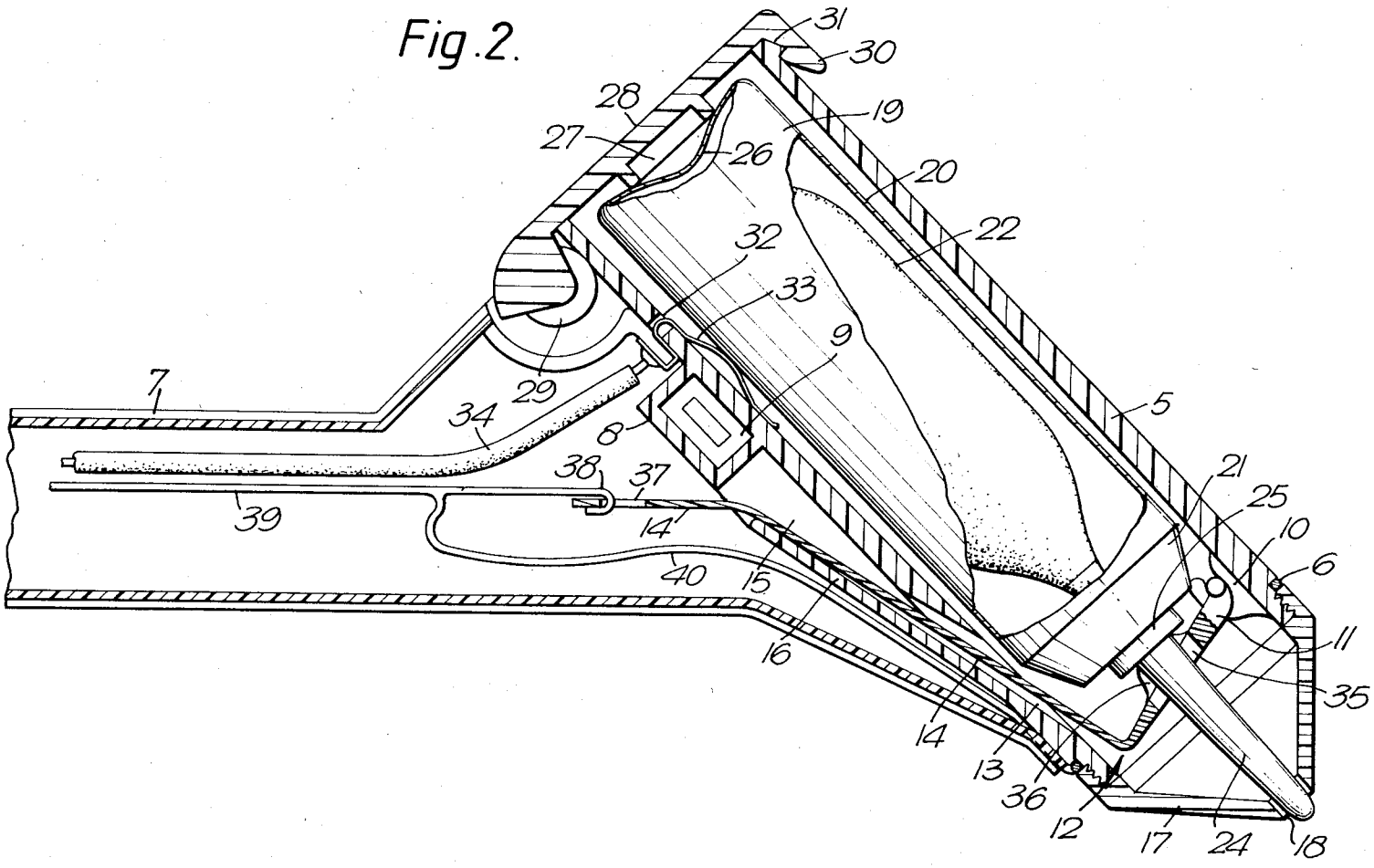
FIG. 2 is a longitudinal section of the sprayhead part of the apparatus.

Referring now to FIG. 2 one of the shell mouldings is indicated by reference numeral 7. The sleeve 5 is moulded from an electrically insulating material and is of generally cylindrical configuration. Sleeve 5 is located on the shell mouldings by means of an integrally moulded, open-sided, box structure 8 which engages with a hollow projection 9 on moulding 7 and a corresponding projection on the other shell moulding. Sleeve 5 is provided with integrally moulded projections 10 in which one end 11 of a valve-actuating member 12 is pivotally mounted.

Sleeve 5 is also provided with an opening 13 through its wall, through which the other end 14 of the valve-actuating member 12 passes, and integral flanges 15, 16 which act as a guide for the end 14 of the valve-actuating member 12.

Screw mounted on the end of the sleeve 5 is a nose cone 17 having an opening 18 through which the end of the cartridge nozzle can project.

The cartridge 19, which is shown partly in section in FIG. 2, is a metal can 20 provided with a closure 21 incorporating a valve assembly, typically of the type commonly employed in aerosol canisters. Inside can 20 a flexible bag 22 is mounted on the inlet 23 to the valve assembly. The liquid to be sprayed is contained within bag 22 while the space between bag 22 and the walls of the can 20 is charged with a volatile liquid pressurising agent, e.g. a fluorocarbon such as dichlorodifluoromethane. The cartridge 19 also has a nozzle 24 having a fine bore (not shown) extending longitudinally therethrough. The nozzle 24 is formed integrally with a flange 25 forming part of the valve assembly. Movement of flange 25 axially towards the base 26 of cartridge 19 effects opening of the valve to permit liquid to flow from the reservoir out of the cartridge via the fine bore extending through nozzle 24. The bore is typically of 1 mm diameter while the tip of the nozzle 24 is typically of hemispherical configuration of 3–5 mm diameter.

Cartridge 19 is held in place by a rib 27 on a cap 28 engaging with the base 26 of the cartridge and holding the flange 25 against the valve actuating member 12. The cap 28 is moulded from an electrically insulating plastics material and is pivotally mounted in a boss 29 in shell mould 7 and a corresponding boss in the other shell mould. Cap 28 has an integral latch 30 engaging with a projection 31 moulded integrally with sleeve 5.

Extending through an opening 32 in sleeve 5 is a spring metal contact strip 33 which is held in place between the shell mouldings and the wall of sleeve 5. Electrically connected, e.g. soldered, to strip 33 is a high voltage lead 34 from a generator located in the handle portion of the apparatus. On application of a high voltage to lead 34, the high voltage is applied, via contact strip 32, to the metal can cartridge 19 and hence, via conduction through the cartridge and its contents, to the nozzle 24.

The valve-actuating member 12 is a moulding of an electrically insulating plastics material of such cross section that the portion in the vicinity of nozzle 24, flange 25, and mounting 10 is relatively rigid but the free end 14 is relatively flexible. The valve-actuating member 12 is provided with an opening 35 through which nozzle 24 projects, and projections 36 which engage with flange 25 on either side of nozzle 24. It is then seen that longitudinal movement of the free end 14 of the valve-actuating member 12 away from mounting 10 causes flange 25 to be depressed thus opening the valve. The free end 14 of the valve-actuating member 12 is provided with a slot 37 which engages with a hook 38 of a metal wire 39 which extends along the shaft of the elongated member to the trigger 3.

As mentioned hereinbefore, extending round sleeve 5 is a metal wire 6 acting as a field adjusting electrode. A flexible extension 40 of wire 6 passes through a groove (shown dotted in FIG. 2) in shell moulding 7 and is electrically connected, e.g. soldered, to wire 39.

Wires 39 and 40 thus provide an electrical connection from the trigger 3 to the field adjusting electrode 6 and wire 39 also provides a mechanical connection from trigger 3 to the valve actuating member 12.

Figure 3:
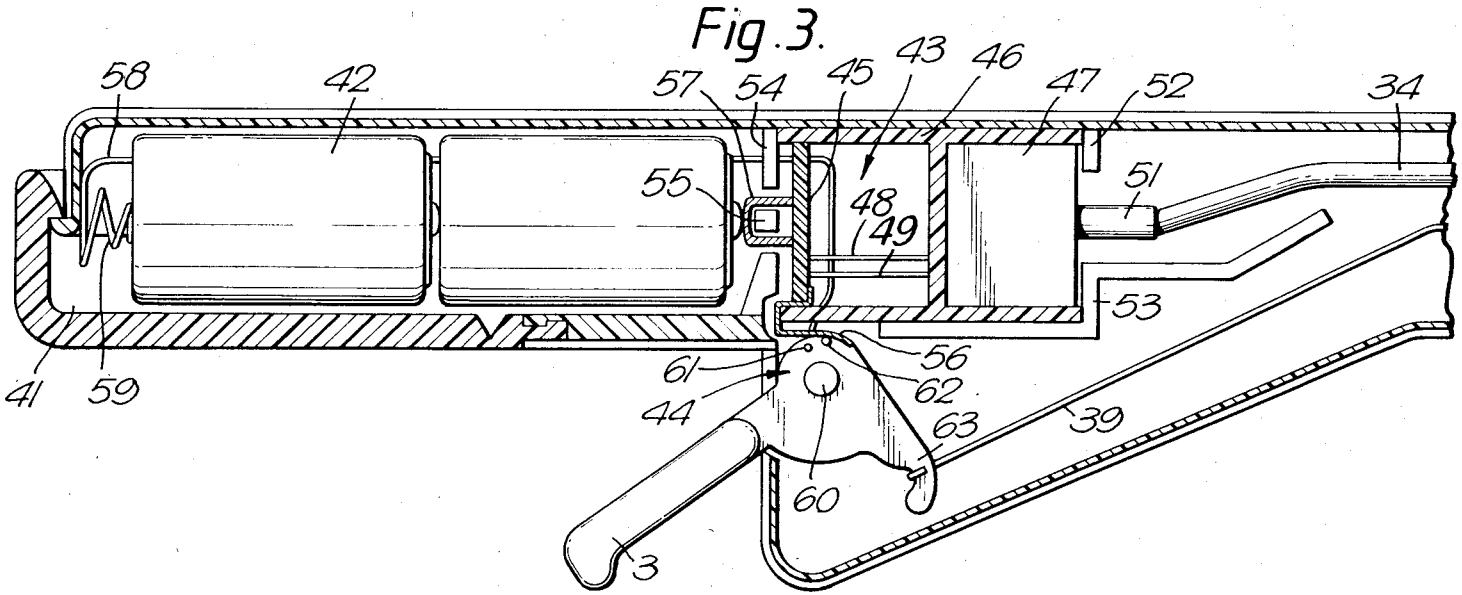
FIG. 3 is a longitudinal section of the handle part of the apparatus.

The handle portion 2 of the apparatus is shown in FIG. 3.

Provided within the handle portion 2 of the casing is a compartment 41 for receipt of a series train of two dry cell batteries 42; a high voltage generator assembly 43; and a trigger assembly 44.

Figure 4:
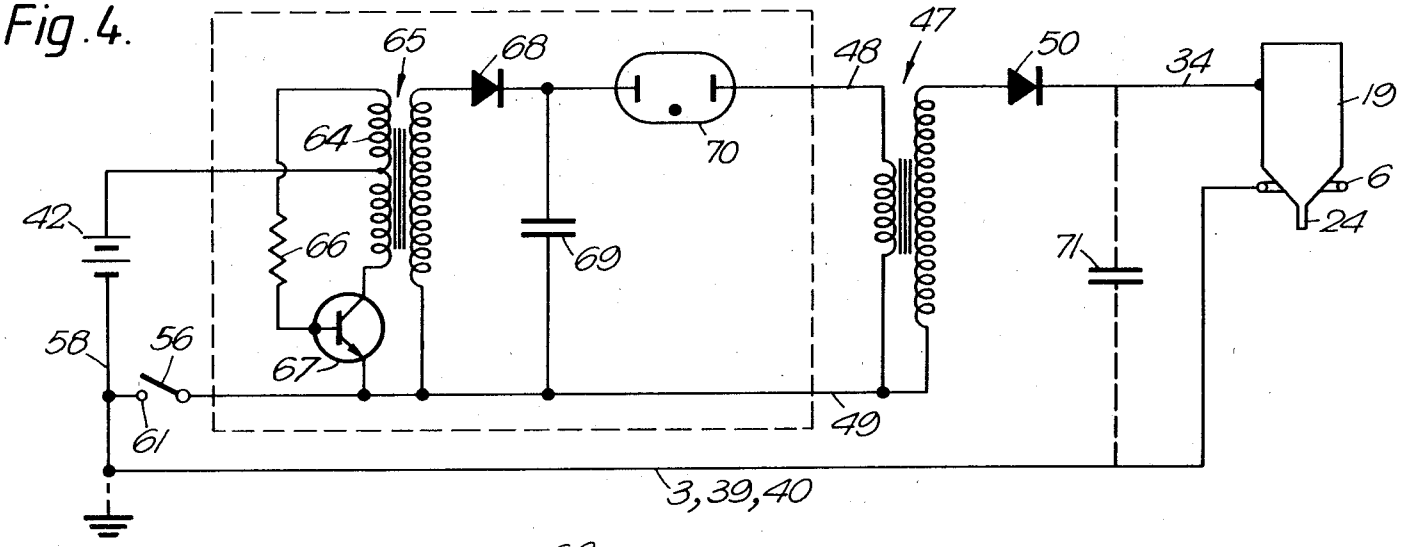
FIG. 4 is a circuit diagram.

The generator assembly comprises a printed circuit board 45 on which are mounted the various components shown in FIG. 4 as enclosed within the dotted box. For simplicity these components are not shown in FIG. 3. Board 45 is mounted in a moulding 46 of electrically insulating plastics material. Also mounted in moulding 46 is an output step-up transformer 47 which is connected to board 45 by leads 48, 49. The high voltage output from transformer 47 is fed, via a high voltage diode 50, (not shown in FIG. 3), to the high voltage lead 34 via a contact within sleeve 51 attached to transformer 47. The generator assembly 43 is located by projections 52, 53, 54 and 55 integral with shell moulding 7 and by corresponding projections (not shown) in the other shell moulding.

Board 45 is provided with two electrical contacts 56, 57. Contact 56 is a spring metal strip which extends round moulding 46 to the trigger assembly 44 while contact 57 projects into the battery compartment 41 wherein it contacts the positive terminal of the train of batteries 42. Extending the length of compartment 41 is a wire 58. At the rear end of compartment 41, wire 58 is formed as a coil spring contact 59 which urges the trains of batteries 42 into engagement with contaxt 57. Wire 58 also serves to connect the negative contact of the battery train to the trigger assembly 44.

The trigger assembly 44 comprises a trigger lever 3 made of an electrically conductive plastics material pivotably mounted on bosses 60 in the shell mouldings. The free end of wire 58 from the battery compartment extends through a hole in lever 3 to form a contact pin 61. Also mounted in lever 3 is a pin 62 formed from an electrically insulating material. Pin 62 engages with the spring contact strip 56 from board 45 to hold the strip 56 out of engagement with pin 61 when the trigger lever 3 is in the "off" position. Strip contact 56 is laterally spaced from lever 3, and hence insulated therefrom when the trigger is in the "off" position. Rotation of lever 3 from the "off" position causes the contact pin 61 to engage with strip contact 36 thus completing the circuit to supply power from the batteries 42 to the generator.

Hooked round an integral extension 63 to trigger lever 3 is the connecting wire 39. A return spring (not shown) is provided to bias lever 3 to the "off" position.

In use the operator's finger contacting trigger lever 3 provides a connection, through the operator, to earth thus earthing the field intensifying electrode 6 and the negative side of the battery train.

Referring now to FIG. 4, the low voltage part of the high voltage generator circuit consists of a conventional transistorised saturation oscillator formed by the primary 64 of a first step-up transformer 65, resistor 66 and a transistor 67. Typically this oscillator has a frequency of the order of 10 to 100 kHz. The secondary of transformer 65 is connected, via a diode 68, to a capacitor 69. Connected in parallel with capacitor 69 is a gas-gap discharge tube 70 connected in series with the primary of the output step-up transformer 47. Shown dotted in the high voltage output circuit of FIG. 4 is a capacitor 71. This capacitor is not a discrete component but represents the capacitance between the high voltage lead 34, the cartridge 19, and the nozzle 24 and the adjacent "earthed" components, e.g. wires 39 and 40, and the field intensifying electrode 6.

To ensure that the capacitor 71 has the desired value, typically 20–40 pF, guides (not shown) may be provided in the shell mouldings to hold wire 39 in the desired spatial relationship to the high voltage lead 34.

In operation the saturation oscillator gives rise to current pulses in the secondary of transformer 65 which charge capacitor 69 via diode 68. When the voltage across capacitor 69 reaches the striking voltage of gas-gap discharge tube 70, the latter conducts, discharging capacitor 69 through the primary of output transformer 47, until the voltage across the gas-gap discharge tube falls to the extinguishing voltage. Typically the striking voltage is 150–250 V and the extinguishing voltage is less than 10 V.

The discharge of capacitor 69 through the primary of transformer 47 produces high voltage pulses in the secondary thereof: these high voltage pulses charge capacitor 71 via diode 50 and thus maintain a sufficiently high potential between nozzle 24 and the field intensifying electrode 6 for electrostatic atomisation of the liquid from nozzle 24.

The frequency with which the high voltage pulses are produced is determined by the value of capacitor 69, the impedance of the secondary of transformer 65 and the magnitude and frequency of the pulses produced by the saturation oscillator.

In an example a pesticide composition of resistivity $8\times10^7$ ohm. cm was sprayed from apparatus of the type shown in FIGS. 1 to 4. The voltage at nozzle 24 was about 18 kV, the liquid flow rate 1 ml/min, the frequency of the high voltage pulses about 25 Hz. The capacitance of capacitor 71 was about 20 pF and primarily formed by the capacitance beween wires 34 and 39 which were each about 0.9 m long and spaced apart by an average of about 2 cm. The series train of batteries 42 gave a voltage of 3.1 V and the current drain thereon was about 150 mA.

Figure 5:
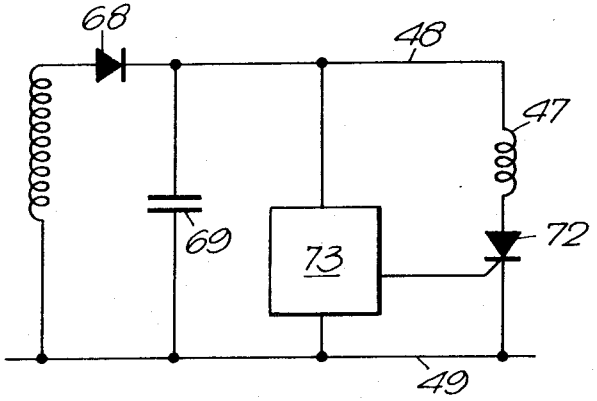
FIG. 5 shows a modification of part of the circuit depicted in FIG. 4.

In the modified circuit of FIG. 5 the arrangement of the generator is modified by the replacement of the gas-gap discharge tube 70 by a thyristor 72 and by the incorporation of a temperature dependent triggering circuit 73, the output of which is applied to the gate of thyristor 72.

This temperature dependent triggering circuit incorporates a temperature sensitive component, e.g. a thermistor, and is arranged such that as the temperature increases, thyristor 72 is triggered to conduct, thus discharging capacitor 69 through the primary of output transformer 47, at increasing voltages across capacitor 69. Although this results in a reduction of the frequency of discharge of capacitor 69, the rate of transfer of energy to the high voltage circuit is increased thus giving an increased voltage at the nozzle 24.

As the temperature increases the pressure exerted by the volatile liquid in can 20 increases, thus increasing the liquid flow rate through nozzle 24. The characteristic of the temperature dependent triggering circuit 73 is arranged so that the voltage at the nozzle 24 is increased, as the flow rate through nozzle 24 increases, so as to give the desired droplet size spectrum.

We claim:

1. Portable electrostatic spraying apparatus including
(a) a spray nozzle,
(b) means to supply liquid to be sprayed to said spray nozzle,
(c) a low voltage power source,
(d) a high voltage generator powered by said low voltage power source, whereby rectified high voltage pulses may be produced across its output,
(e) a capacitor connected to said nozzle and to one side of said generator output, whereby said capacitor may be charged by said rectified high voltage pulses so that said nozzle may be maintained at a sufficiently high potential, with respect to the other side of said generator output, to cause electrostatic atomisation of said liquid at said nozzle, characterised in that capacitor has a value below $$\frac{2 \times 10^4}{V^2} \text{ pF},$$

where V is the average voltage, expressed in kilovolts, that said generator is capable of maintaining at said nozzle, and in that said capacitor is formed by the capacitance between a lead connecting said one side of the generator output to said nozzle and a lead connected to said other side of the generator output, said generator being capable of producing said high voltage pulses of such magnitude and frequency that the potential at said nozzle may be maintained at a sufficient value to cause electrostatic atomisation of the liquid but without corona discharge.

2. Apparatus according to claim 1 wherein said capacitor has a value above $$\frac{2 \times 10^3}{V^2} \text{ pF}.$$

3. Apparatus according to claim 1 wherein said capacitor has a value between 10 and 50 pF.

4. Apparatus according to claim 1 wherein said generator is capable of maintaining a voltage between 10 and 25 kV at said nozzle.

5. Apparatus according to claim 1 wherein said high voltage pulses are rectified in said generator by a diode having a leakage current of less than 1 $\mu$A at 37 kV and 20° C.

6. Apparatus according to claim 1 wherein said generator includes a capacitor that can be discharged through the primary of a step-up transformer via a triggering device whereby discharge of said capacitor through said primary produces high voltage pulses in the secondary of said transformer.

7. Apparatus according to claim 1 wherein said generator produces said high voltage pulses at a frequency below 50 Hz.

8. Apparatus according to claim 1 wherein an electrically conductive member is positioned adjacent to, but spaced from said nozzle, and connected to said other side of the generator output, and said capacitor of value below $$\frac{2 \times 10^4}{V^2} \text{ pF}$$

is formed by the lead connecting said one side of the generator output to said nozzle and the lead connecting said other side of the generator output to said electrically conductive member.

9. Apparatus according to claim 1 wherein said means to supply liquid to said spray nozzle includes a mechanically operated valve actuated by a trigger remote from said valve and said capacitor of value below $$\frac{2 \times 10^4}{V^2} \text{ pF}$$

is formed by the lead connecting said one side of the generator output to said nozzle and an electrically conductive member forming part of the mechanical connection from said trigger to said valve, said electrically conductive member being electrically connected to said other side of the generator output.

10. Apparatus according to claim 1 wherein said means to supply liquid to said nozzle includes a pressurised container and means are provided to monitor the ambient temperature and to vary the average voltage applied to the nozzle in response to said monitored temperature to maintain the average droplet size of the liquid sprayed from said nozzle within a predetermined range.

* * * * *